US005522594A

United States Patent [19]

Taylor et al.

[11] Patent Number: 5,522,594

[45] Date of Patent: Jun. 4, 1996

[54] BALLISTIC IMPELLER GOLF CLUB

[76] Inventors: Roy H. Taylor, 38940 Cherry Ct., Fremont, Calif. 94536; D. James Duncalf, 41251 Trenouth St., Fremont, Calif. 94538

[21] Appl. No.: 500,413

[22] Filed: Jul. 10, 1995

Related U.S. Application Data

[63] Continuation-in-part of Ser. No. 343,764, Nov. 21, 1994.

[51] Int. Cl.[6] ..... A63B 69/36

[52] U.S. Cl. ..... 473/131; 473/282

[58] Field of Search ..... 273/193 R, 194 R, 273/186.2, 187.4, 167 J, 87.2, 87.4, 129 R, 32 R, 77 R, 162 R, 129 S, 129 T, 129 V, 167 R, 194 A; 434/252; 124/16, 31, 52, 45, 7

[56] References Cited

U.S. PATENT DOCUMENTS

| | | | |
|---|---|---|---|
| 769,939 | 9/1904 | Clark . | |
| 1,204,803 | 11/1916 | McCullough . | |
| 1,739,467 | 12/1929 | Klutho . | |
| 1,739,468 | 12/1929 | Klutho . | |
| 2,003,290 | 6/1935 | Gurney . | |
| 2,399,711 | 5/1946 | Smith . | |
| 2,505,428 | 4/1950 | Pope . | |
| 2,719,716 | 10/1955 | Sawtelle . | |
| 3,341,202 | 9/1967 | Stars . | |
| 3,469,846 | 9/1969 | Lippert . | |
| 3,572,309 | 3/1971 | De Freitas . | |
| 3,893,673 | 7/1975 | Welch | 273/193 R |
| 3,938,272 | 2/1976 | Ditto et al. . | |
| 4,424,972 | 1/1984 | Vinette . | |
| 4,488,723 | 12/1984 | Lagrow . | |

FOREIGN PATENT DOCUMENTS

| | | | |
|---|---|---|---|
| 1181539 | 6/1959 | France | 273/186.2 |

OTHER PUBLICATIONS

"Times–Union" Newspaper, Friday, Apr. 20, 1956 issue, p. 31.

*Primary Examiner*—Sebastiano Passaniti
*Attorney, Agent, or Firm*—Gregory S. Smith

[57] ABSTRACT

A golf club for impelling a golf ball without swinging. The club uses expanding gas generated by an exploding charge to move a piston having an attached strike plate against a golf ball, impelling the ball down the fairway toward the green. The club is prepared for use by inserting an explosive charge and cocking the firing mechanism. The club is fired by placing the head of the club a short distance behind the ball, aiming the ball by aligning the striking plate with the ball, releasing a safety, and triggering the firing mechanism.

11 Claims, 6 Drawing Sheets

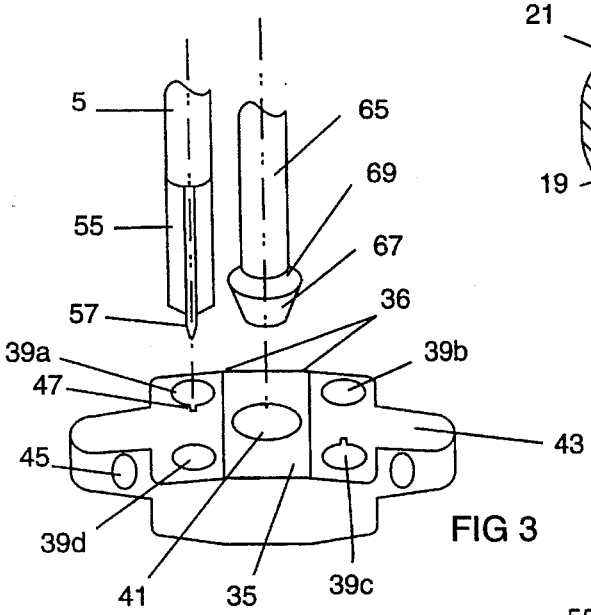
FIG 3
FIG 2
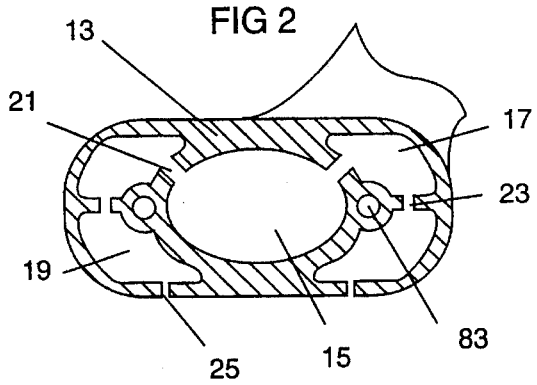
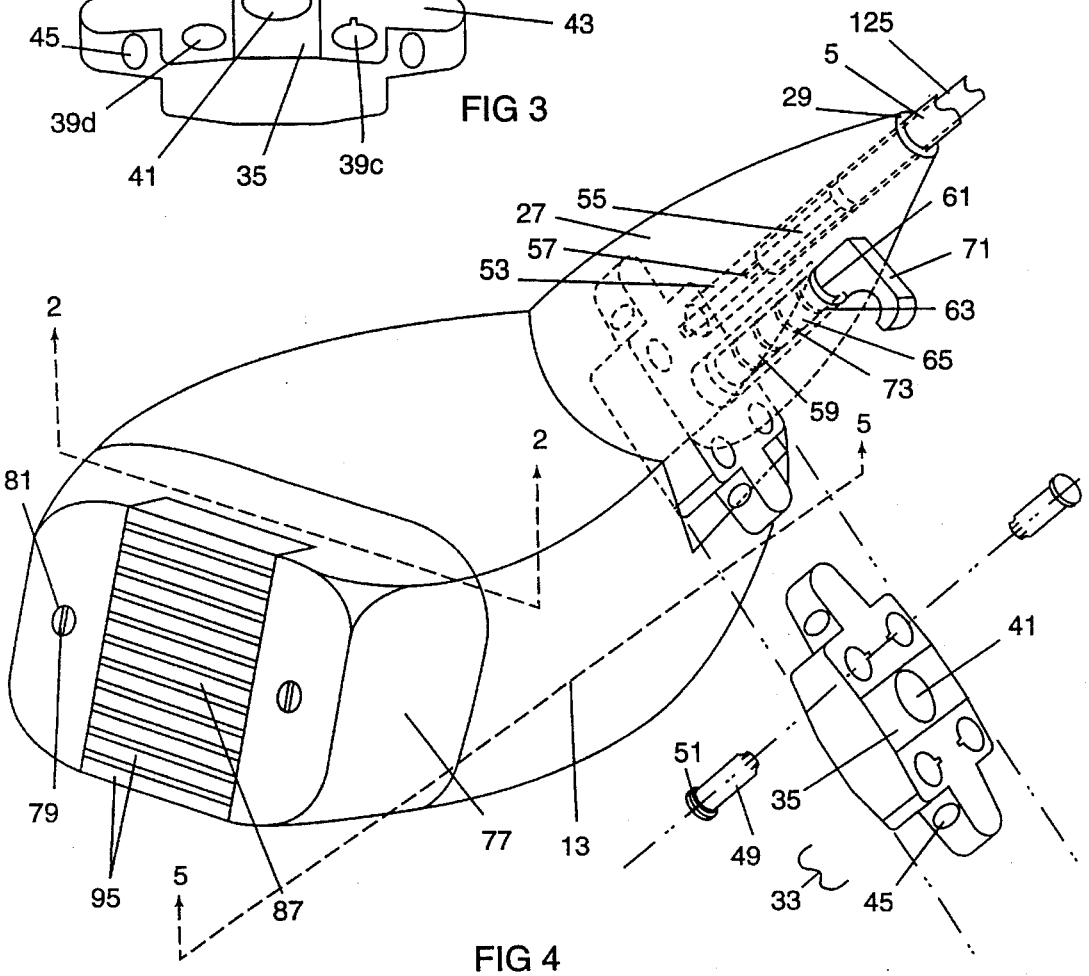
FIG 4

BALLISTIC IMPELLER GOLF CLUB

CROSS REFERENCE TO RELATED APPLICATION

This application is a continuation-in-part of a previous co-pending application filed in the United States Patent and Trademark Office by Roy H. Taylor and Jim Duncalf on Nov. 21, 1994, titled "Golf Club Utilizing a Ballistic Ball Impeller", and assigned the Ser. No. 08/343764, status pending.

BACKGROUND OF THE INVENTION

1. Field of the Invention

The present invention relates to golf clubs. In particular, the present invention relates to a golf club that is used to impel a golf ball without swinging the club.

2. Description of the Prior Art

The game of golf has evolved utilizing clubs which are swung into contact with the golf ball to provide the necessary energy to impel the ball down the fairway or course. Various types of clubs are used to provide different trajectories to the ball, and for use at different distances from the green.

Many people who would otherwise enjoy the sport of golf are not capable of physically swinging a club hard enough or accurately enough to participate in the sport. In particular, many individuals who are capable of using a putter are not capable of driving the golf ball a significant distance from the tee toward the green, whether due to disability or lack of strength or dexterity.

In the past, others have tried unsuccessfully to solve this problem by inventing clubs which generate impelling force against the golf ball independent of the energy imparted by the swing of the club. These attempts have failed, however, because unlike the present invention, the club must still be swung into contact with the ball.

For example, Clark U.S. Pat. No. 769,939, discloses a golf club which used a spring in a club head to add additional energy to the swing of the club. The energy stored in the compressed spring was released by impact with the ball. The sole purpose of the invention was to add a few yards of distance when the club was used to hit the ball. The practical success of this concept is limited since the peak energy release of the spring and contact with the ball would have to occur simultaneously or precisely in phase to achieve optimum results. Additionally, this design made the club heavier thereby increasing the difficulty of striking the ball accurately on the club's "sweet spot", which is more important than additional force in obtaining more distance.

Another example is Celestin, French Patent 1,181,539, which discloses a golf club which uses an explosive charge in a club head to add additional energy to the swing of the club. The club disclosed in Celestin is swung against the ball. The impact causes a piston having an attached firing pin to contact an explosive charge in the head of the club. The charge causes the piston to move outwardly toward the ball impelling the ball away from the club. Again, the practical success of this concept is limited since the peak energy release of the explosive charge and contact with the ball must occur simultaneously or precisely in phase to achieve optimum results. Additionally, the "sweet spot" on the Celestin club is difficult to strike because the striking surface of the club is small and convex. Therefore the accuracy of the club is likely to be very poor.

The present invention overcomes these deficiencies and provides a way for golfers with physical handicaps or golfers with limited playing ability to perform abreast with avid players. The ballistic impeller golf club of the present invention does not need to be swung into contact with the golf ball. The club head is simply placed behind the ball, observing the proper axis toward the flag, the safety is released, and the trigger button is pressed. Thus detonating an explosive charge which propels the ball any desired distance from 2 yards to 250 yards depending upon the player's selection powder load in the explosive charge.

Additional, ballistic impeller golf clubs can be made for a variety of golf purposes, for instance, clubs made for left handed players, and clubs designed to impel the ball into a slice or hook trajectory.

SUMMARY OF THE INVENTION

The general object of the present invention is to provide a ballistic impeller golf club that is capable of accurately driving a golf ball a controllable distance down the course without the necessity of swinging the club.

Another object of the invention is to create a ballistic impeller golf club that is superficially similar to a conventional golf club in appearance, is lightweight, and fits easily in a conventional golf bag.

Another object of the invention is to create a ballistic impeller golf club of sturdy construction capable of withstanding rough handling over a long period of time.

These and other objects of the invention will be apparent to those skilled in the art from the detailed description of the preferred embodiment of the invention below.

In general the ballistic impeller golf club comprises club head, a hollow shaft affixed to the club head at one end of the shaft, and handle assembly fixed to the other end of the shaft. The club head further includes a front face, and a strike plate associated with the front face of the club head. The strike plate is rigidly fixed to a piston which is slideably supported within a piston cylinder formed within the club head. The club head further comprises urging means comprising means for generating gas under pressure by detonating an explosive charge effective to force the piston along the piston cylinder urging the attached strike plate away from the front face of the club head into contact with the golf ball impelling the golf ball down the course. Also included within the club head is breach chamber for receiving a means for removeably inserting and positioning the explosive charge for detonation.

The golf club further includes a triggering means for detonating the explosive charge designed and arranged to be fired by a person holding the club in ready position with the head of the club a short distance behind the golf ball.

A person operating the ballistic golf club may trigger the explosive charge, without swinging the golf club, causing gas pressure to urge the piston along the piston cylinder urging the attached strike plate away from the front face of the club into contact with a golf ball impelling the golf ball down the course.

BRIEF DESCRIPTION OF THE DRAWINGS

A preferred embodiment of the present invention is further described in connection with the accompanying drawings, in which:

FIG. 2 shows a cross section of the piston housing.

FIG. 3 shows a perspective view of the cartridge holder, firing pin and pin.

FIG. 4 shows a front quarter perspective view of the golf club head.

DETAILED DESCRIPTION

Reference will now be made in detail to a presently preferred embodiment of the invention as illustrated in the accompanying drawings.

Figure 1:
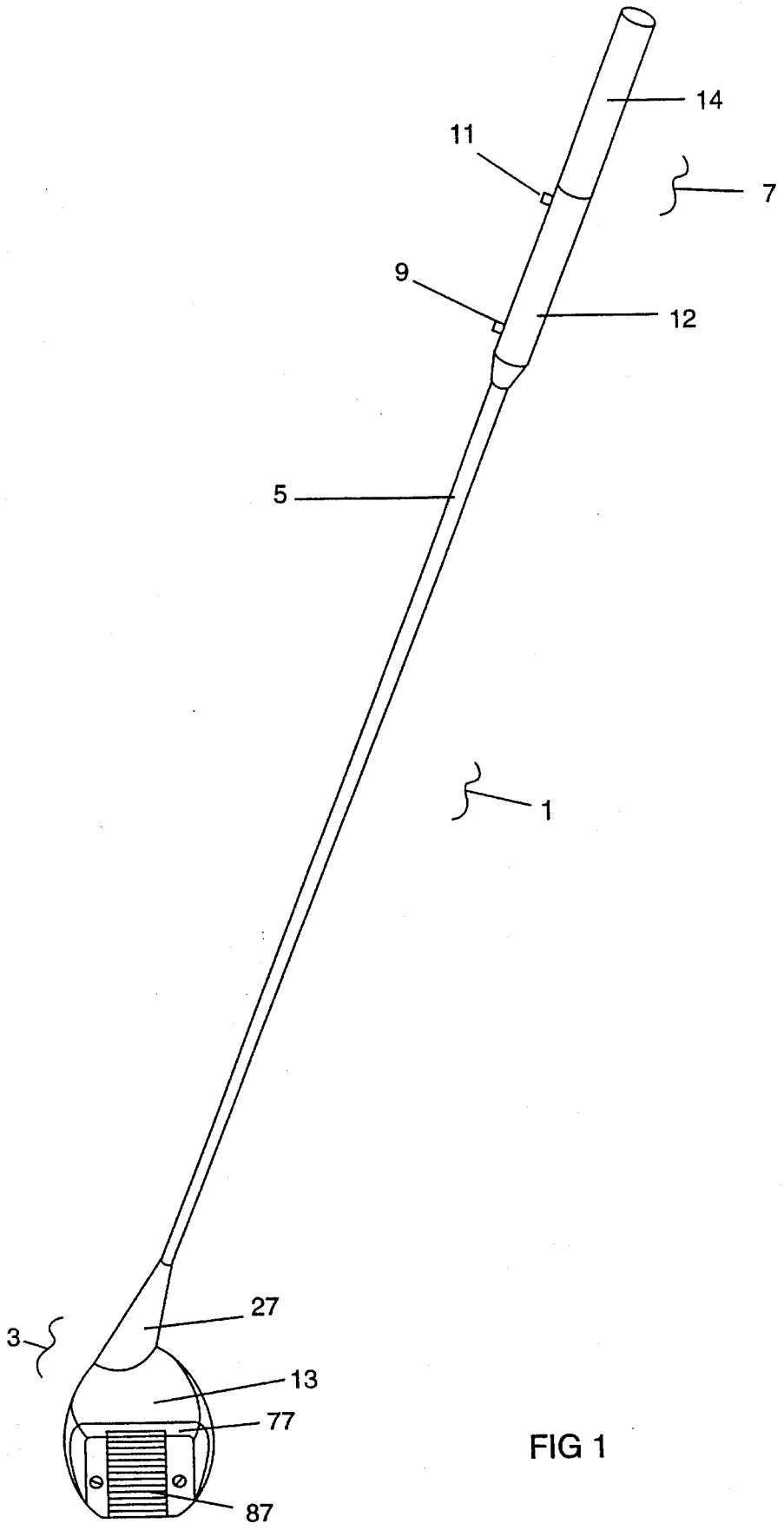
FIG. 1 shows a perspective overall view of the ballistic golf club.

In FIG. 1 the Ballistic Impeller Golf Club 1 is shown having a club head 3, a hollow shaft 5 affixed to the club head 3 extending upwardly and slightly outwardly from club head 3, and handle assembly 7 including trigger button 9, safety button 11, and rubberized handle covers 12 and 14. Club head 3 includes piston housing 13, club face 77, strike plate 87, and firing pin housing 27. Club head 3 is preferably made of aluminum or stainless steel, and is of a mass calculated to counteract the recoil in the impelling cycle.

Figure 6:
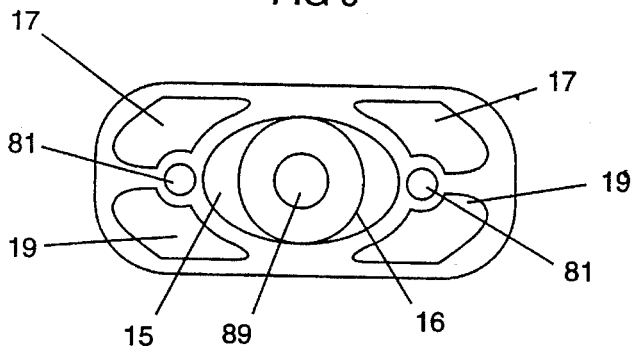
FIG. 6 shows a perspective view of the front face piece of the golf club head.

Referring to FIGS. 2, 4, and 6, in a preferred embodiment, piston cylinder 15 has an oval cross section. In an alternate embodiment, piston cylinder 15 could have circular, square or other shaped cross section. Also formed in club head 3 are four silencer chambers comprising two upper silencer chambers 17 on each side of piston cylinder 15, and two lower silencer chambers 19 on each side of piston cylinder 15. Gas communication is possible between piston cylinder 15 and upper silencer chambers 17 through cylinder discharge pods 21, and between each upper silencer chambers 17 and their corresponding lower silencer chambers 19 through upper silencer discharge pods 23, and finally, between each lower silencer chamber 19 and the exterior of the club head 3 through lower silencer discharge ports 25. In a preferred embodiment the various discharge pods are channel shaped, but in alternate embodiments, the discharge pods can be circular or oval shaped. Alternate embodiments of piston housing 13 could include fewer silencer chambers, including no silencer chambers, or more silencer chambers, than are shown in FIG. 2.

Figure 5:
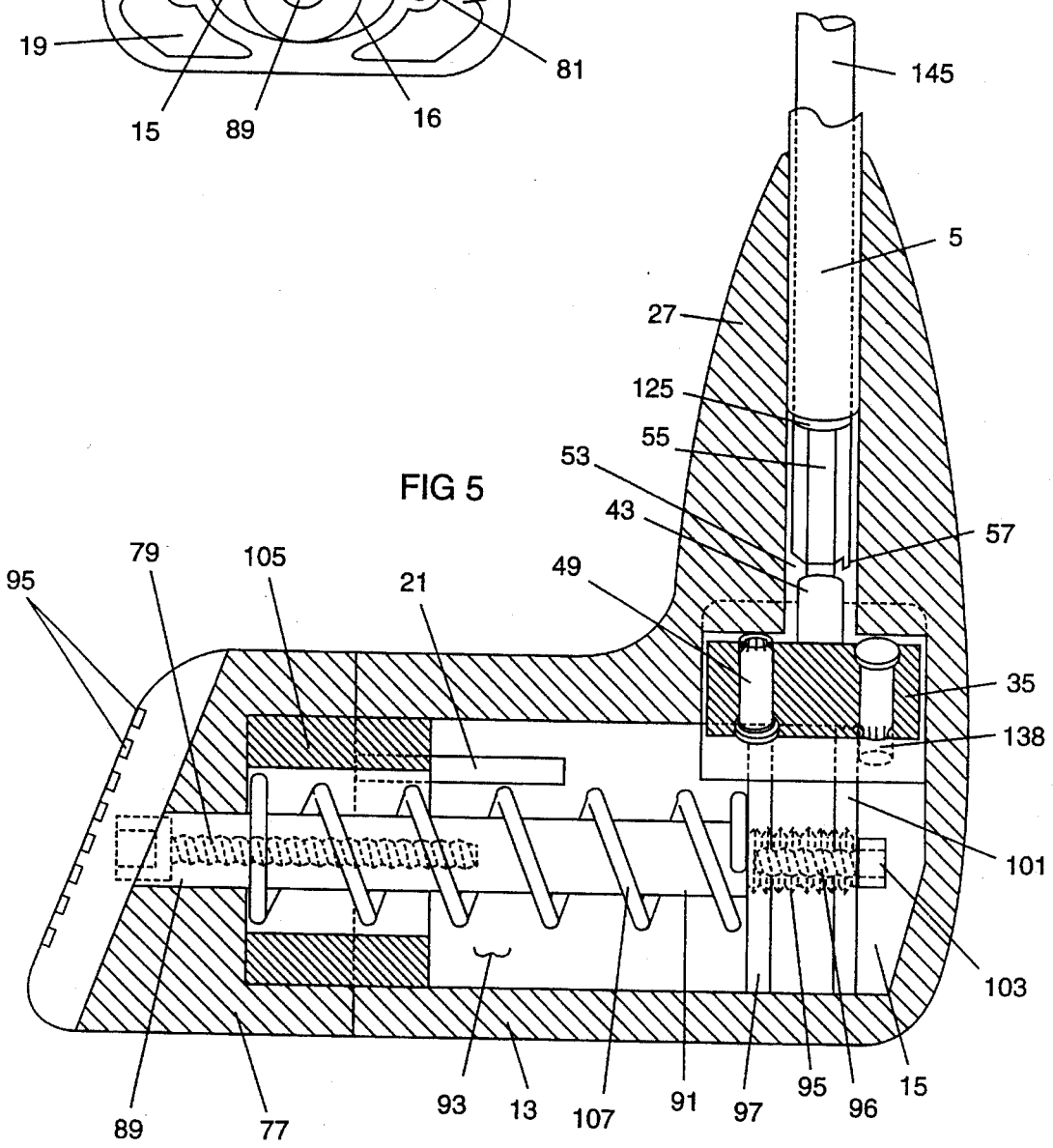
FIG. 5 shows a sectional view of the golf club head.

Club face 77 is removeably coupled to piston housing 13, in a preferred embodiment shown in FIGS 4 and 5, by screws 79 which are received in face mounting screw holes 81 and threaded into club face mounting screw holes 83. Club face 77 further includes a strike plate channel 85 for receiving strike plate 87, when strike plate 87 is in ready position, and piston rod guide hole 89 for receiving piston rod 91. Piston rod 91 is preferably cylindrical, but in alternate embodiments piston rod 91 could have square, oval, or other shaped cross section. In a preferred embodiment, shallow horizontal grooves 95 are machined into the front of strike plate 87. Various depths and widths of grooves are possible. Alternate embodiments may include various patterns of grooves. Front face 78 of club face 77 and strike plate groove 85 may be cut at varying angles from vertical. It is anticipated that a set of ballistic golf clubs will include at least three clubs with one having front face 78 cut at a 14 degree angle from vertical, a second cut at 19 degrees from vertical, and a third at 28 degrees from vertical.

Referring to FIG. 5, piston 93 comprises piston rod 91 having an outer end. The outer end of piston rod 91 extends from inside piston cylinder 15 through piston rod guide hole 89 in club face 77. Piston rod guide hole 89 is large enough to slideably receive piston rod 93 and to restrict the motion of piston rod 93 to axial back and forth travel. Strike plate 87, is fixed to the outer end of piston rod 93. The inner end of piston rod 91 includes, a threaded end portion 95, and a threaded recess 96. Piston spring bearing member 97, and piston seal ring 99, are threadably coupled to the threaded end of piston rod 91 with piston spring bearing member closes to the front face 77 of club head 3. Piston crown 101 is coupled to the inner end of piston rod 91 by screw 103 threadably coupled in threaded recess 95. Piston seal ring 99 is preferably composed of high impact plastic, nylon, or teflon.

Piston snubber marshmallow ring 105 is placed in circular recess 16 in the forward end of piston cylinder 15 of club face 77. Helical compression piston return spring 107 is engaged over and around piston rod 91 with one end of piston return spring 107 passing through piston snubber marshmallow ring 105 and engaging against club face 77, and the other end engaging piston spring bearing member 91. Piston return spring 107 need not be attached to either club face 77 or piston spring bearing member 91 because its inherent spring force will tend to hold it engaged with these shoulders. When fired, piston 93 is urged forward in cylinder 15 by expanding gas, thereby compressing piston return spring 107 and moving strike plate 87 against a golf ball, impelling the golf ball down the course. Piston snubber marshmallow ring 105 and piston return spring 107 decelerates piston 93, and the compressed spring energy stored in piston return spring 107 urges piston 93 back to ready position.

Club head 3 also comprises a firing pin housing 27 protruding upwardly and slightly outwardly from piston housing 13, tapering to form firing pin housing tip 29, to which hollow shaft 5 is attached. In a preferred embodiment, shown in FIG. 4, a rectangular breach chamber 31, having injection port 32 allowing gas communication between breach chamber 31 and piston cylinder 15, is formed within piston housing 13 at the junction between piston housing 13 and firing pin housing 27 for receiving cartridge holder 33. Breach chamber 31 is preferably cut at a 33 degree angle from horizontal with the lowest side open.

In a preferred embodiment, shown in FIG. 3 and 4, Cartridge holder 33 is rectangular having a top surface 35, shown, and an identical bottom surface. Cartridge holder 33 is preferably made of nylon, aluminum, or other material calculated to withstand the force of the expanding gas generated by detonation of cartridge round 49. Four cartridge containment holes 39*a*, 39*b*, 39*c*, and 39*d* extend through cartridge holder 33 from the top surface 35 to the bottom surface, with one containment hole 39 in each corner of cartridge holder 33. Cartridge holder 33 further includes cartridge holder detente 41 in the center of cartridge holder 33 on both the top and bottom surfaces of cartridge holder 33, and two vertical flanges 43 on each short side of cartridge holder 33, having thumb grips 45 formed therein. A slight angle is cut on each side of cartridge holder 33 from line 36 sloping downwardly towards vertical flanges 43 forming a sealing ramp on each side of both the top and bottom surfaces. A matching ramp is cut in the upper surface of breach chamber 31, whereby when cartridge holder 33 is inserted in breach chamber 31 the cartridge containment hole aligned with firing pin 57 is tightly sealed against injection port 138. Cartridge containment holes 39*a* and 39*c* include a firing detente 47 formed in the top surface 35 of cartridge holder 33. The cartridge containment holes 39*b* and 39*d* have identical firing detentes 47 formed in the bottom surface of cartridge holder 33.

In a preferred embodiment .222 caliber cartridge rounds 49 are inserted in each cartridge containment hole 39*a*, 39*b*, 39*c*, and 39*d*, with the cap 51 of each cartridge round 49 positioned on the side of cartridge holder 33 having the firing detente 47 for that cartridge containment hole 39*a*, 39*b*, 39*c*, or 39*d*, best seen in FIG. 2. In alternate embodiments larger or smaller caliber cartridge rounds may be used. The cartridge rounds used in the present invention are low velocity loads manufactured by Winchester Arms Company, however, a variety of other suitable cartridge rounds may be obtained from retail stores.

Returning to firing pin housing 27, in the preferred embodiment, a hexagonal bore 53 extends from firing pin housing tip 29 into breach chamber 31. A hexagonal Firing index pin 55 with a smaller diameter than hexagonal bore 53 is slideably received in hexagonal bore 53, and firing pin 57 is fixed to the lower end of firing index pin 55, whereby firing pin 57 is aligned, when cartridge holder 33 is inserted in breach chamber 31, with both firing detente 47 and with cap 51 of one of cartridge rounds 49. Hexagonal bore 53 is large enough to restrict the motion of hexagonal index pin 55 to axial up and down travel through hexagonal bore 53. In alternate embodiments hexagonal bore 53 can be circular, square, or other shape.

In the preferred embodiment cartridge round 49 is rim shot. Rim shot rounds are detonated when a firing pin hits the rim of cap 51 of cartridge round 49. In an alternate embodiment, cartridge round 49 can be center shot. Firing pin 57 would then be aligned with the center of cap 51 of cartridge round 49.

Firing pin housing 27 further includes latch pin bore 59 extending from the exterior surface of firing pin housing 27 into breach chamber 31. Latch pin bore aperture 61 on the exterior surface of firing pin housing 27 has a diameter smaller than the diameter of latch pin bore 59 thereby forming upper helical latch pin spring shoulder 63. Fixed to the lower end of latch pin 65 is cartridge holder latch 67 having a circumference slightly smaller that the circumference of cartridge holder latch pin bore 59, but larger than the circumference of latch pin 65, thereby forming lower helical latch spring shoulder 69, best seen in FIG. 3. Cartridge holder latch 67 tapers from its largest diameter at lower helical latch spring shoulder 69. Latch pin 65 is slideably received in latch pin bore 59 and extends through latch pin bore aperture 61. Latch pin release handle 71 is fixed to the protruding end of latch pin 59. Latch pin 65 and cartridge holder latch 67 are sized so that movement is restricted to up and down axial travel through latch pin aperture 61 and latch pin bore 59.

Helical compression spring 73 is engaged over and around latch pin 59 with one end of helical compression spring engaging lower helical latch spring shoulder 69, and the other end engaging upper helical latch spring shoulder 63. Helical compression spring 73 need not be attached to either helical latch spring shoulder 63 or 67 because its inherent spring force will tend to hold it engaged with these shoulders. The inherent spring force of helical compression spring 73 will also tend to urge the tapered end of cartridge holder latch 67 into cartridge holder detente 41, thereby removeably coupling cartridge holder 33 in breach chamber 31 with one of cartridge containment holes 39*a*, 39*b*, 39*c*, or 39*d* aligned with firing pin 57 above cartridge holder 33, and with injection port 32 below cartridge holder 33. Cartridge holder 33 may be rotated along a vertical or horizontal axis prior to insertion into breach chamber 31 in order to align any one of cartridge containment holes 39*a*, 39*b*, 39*c*, or 39*d* with firing pin 57 and injection port 32.

Figures 7, 8, 9:
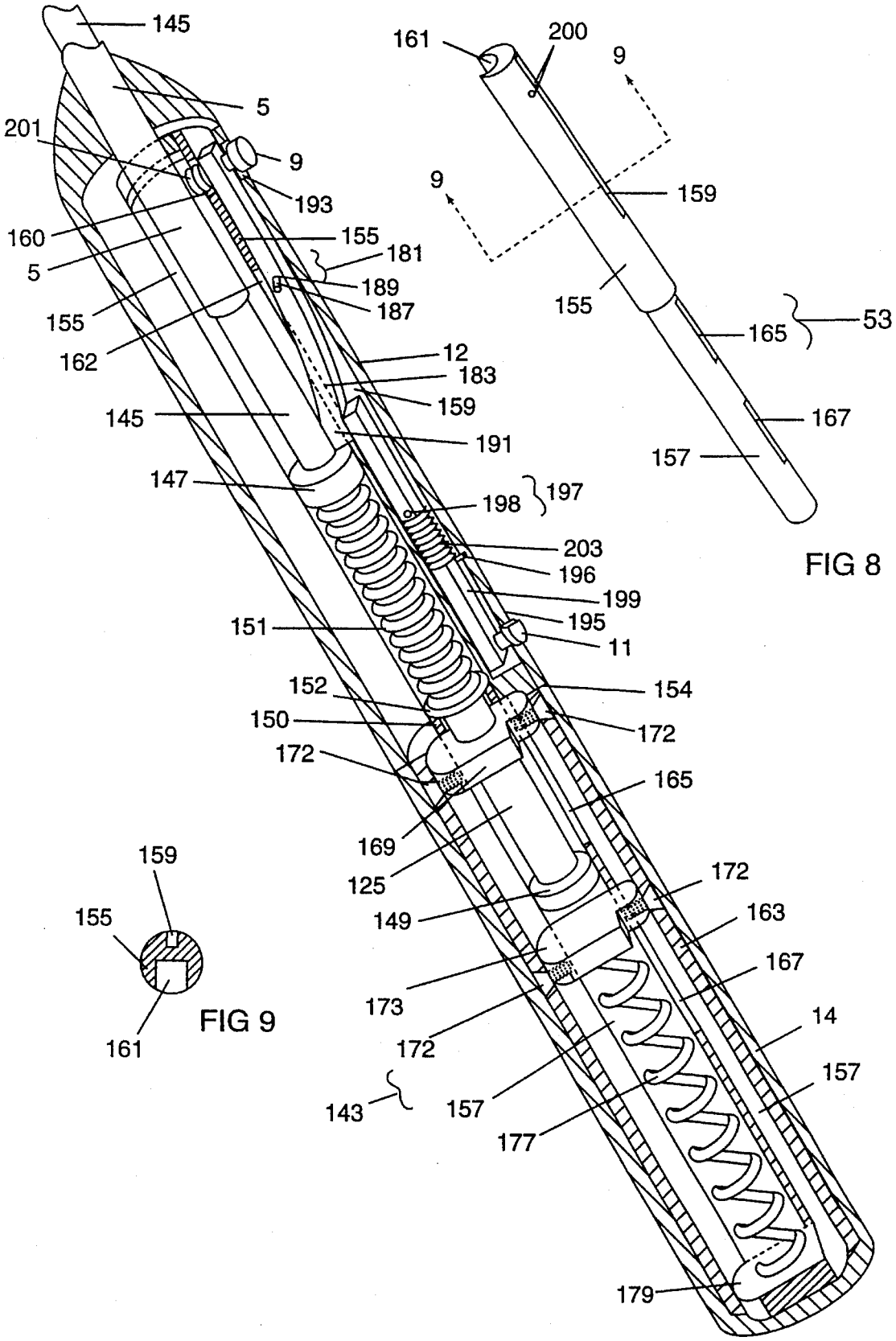
FIG. 7 shows a sectional view of handle assembly.
FIG. 8 shows a perspective view of the handle member.
FIG. 9 shows a sectional view of the handle member.

Referring to FIGS. 7, 8 and 9, elongated hollow shaft 5 is fixed at the end opposite club head 3 to handle assembly 7. Handle assembly 7 includes handle member 153, having a forward member section 155 of a given diameter, a rear member section 157 of smaller diameter, and a spring channel 161 running the length of handle member 153, best seen in FIG. 9. Forward member section 155 of handle member 153 includes trigger and safety groove 159, safety groove 159 including trigger spring slot 160 and trigger slot 162. Rear member section 157 includes forward cocking pawl slot 165, and rear cocking pawl slot 167. The diameter of spring channel 161 abruptly narrows forming firing pin linkage spring shoulder 150, then abruptly widens again resuming its previous diameter. Firing pin linkage 145 is slideably received in hollow shaft 141. firing pin linkage 145 includes trigger shoulder 147 and firing pin head 149, each having a larger diameter than firing pin linkage tube 145. Helical compression firing pin spring 151 is engaged over and around firing pin linkage tube 145 having one end engaged with trigger shoulder 147 and the other engaged with flat washer 152 and firing pin linkage spring shoulder 150.

Rear member section 157 is slideably received in Cocking handle sleeve 163, having an internal diameter larger than the diameter of rear member section 157. Forward cocking pawl 169, having a forward cocking pawl tab 171, is slideably received in rear member section 157 with forward cocking pawl tab 171 extending through forward cocking pawl slot 165. Rear cocking pawl 173 is shaped substantially similar to forward cocking pawl 169, having rear cocking pawl tab 175, and being slideably received in rear member section 157 with rear cocking pawl tab 175 extending through rear cocking pawl slot 167. Forward cocking pawl 169 and rear cocking pawl 173 are fixed to cocking handle sleeve 163 by means of cocking pawl screws 172. Helical compression cocking handle return spring 177 is received within handle member 153 with one end engaged with rear wall 179 of handle member 153 and the other engaged with rear cocking pawl 173. Cocking handle return spring 177 need not be attached to rear wall 179 of handle member 153 or with rear cocking pawl 173 because its inherent spring energy will tend to keep it engaged with these members.

Rubberized handle covers 12 and 14 cover forward member section 155 and cocking handle sleeve 163 respectively, and but together at 154. Handle cover 12 has rubberized handle grip hole 193 through which trigger button 9 extends, and rubberized handle grip slot 195 through which safety button 11 extends.

Trigger mechanism 181 includes trigger member 183 having trigger button 9 attached to the upper surface at forward end of trigger member 183 and pivot pin 187 which passes through trigger member 183 at pivot point 189. Trigger member 183 is arched slightly so that trigger member lever end 191 passes through trigger slot 162 to engage trigger shoulder 147. Each side of trigger pivot pin 187 is received in pivot holes 200 of handle member 153. Helical trigger compression spring 201 passes through trigger spring slot 161 and is engaged with hollow shaft 5 at one end, and at the other end is engage beneath trigger member 183 in substantial proximity to trigger button 7.

Safety mechanism 197 comprises safety member 199 having attached safety slide button 11, and helical safety return spring 203. Safety return spring 203 engages safety pin 198 at one end, and snap ring 196 at the other end.

In cocked position, trigger member lever end 191 is engaged with trigger shoulder 147. Safety member 199 engages trigger member lever 191 preventing release of trigger shoulder 147 and consequently release of firing pin linkage 145.

The firing mechanism is cocked by pulling cocking handle sleeve 163 back away from club head 3 causing forward cocking pawl 169 to engage firing linkage head 149 pulling firing linkage 145 back away from club head 3 until trigger shoulder 147 passes trigger member lever end 191. Trigger member lever end 191 is urged downwardly against firing linkage 145 by trigger compression spring 201. Safety member 199 is pushed forward to engage trigger member lever 191 preventing release of trigger shoulder 147. Cocking handle return spring 177 urges cocking handle sleeve 163 back to ready position.

Figure 10:
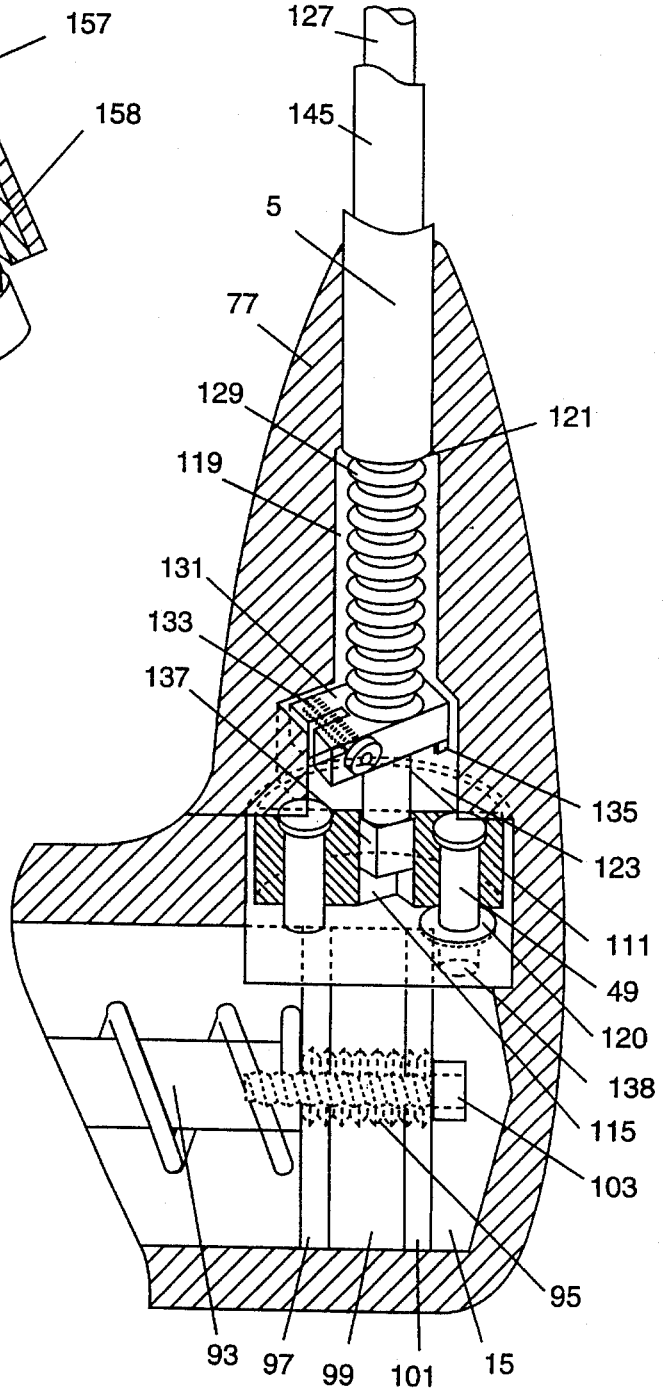
FIG. 10 shows a partial sectional view of an alternate embodiment of the club head.
Figure 13:
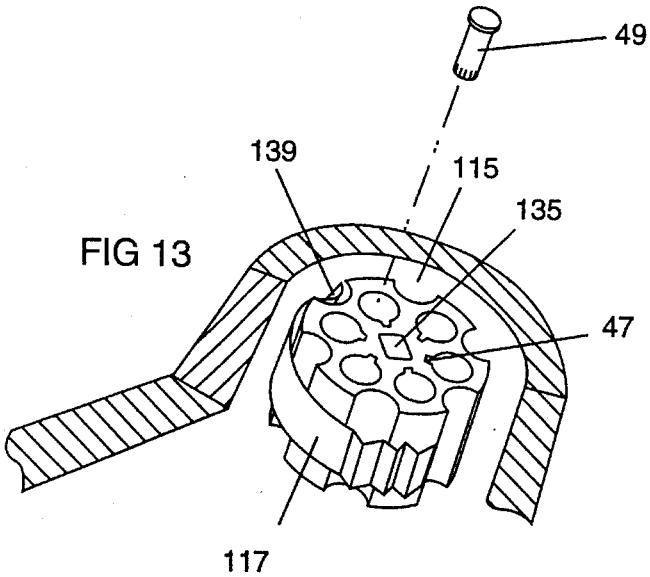
FIG. 13 shows a partial sectional perspective view of an alternate golf club head embodiment showing the ejection and alignment spring shaped cartridge holder.
Figure 12:
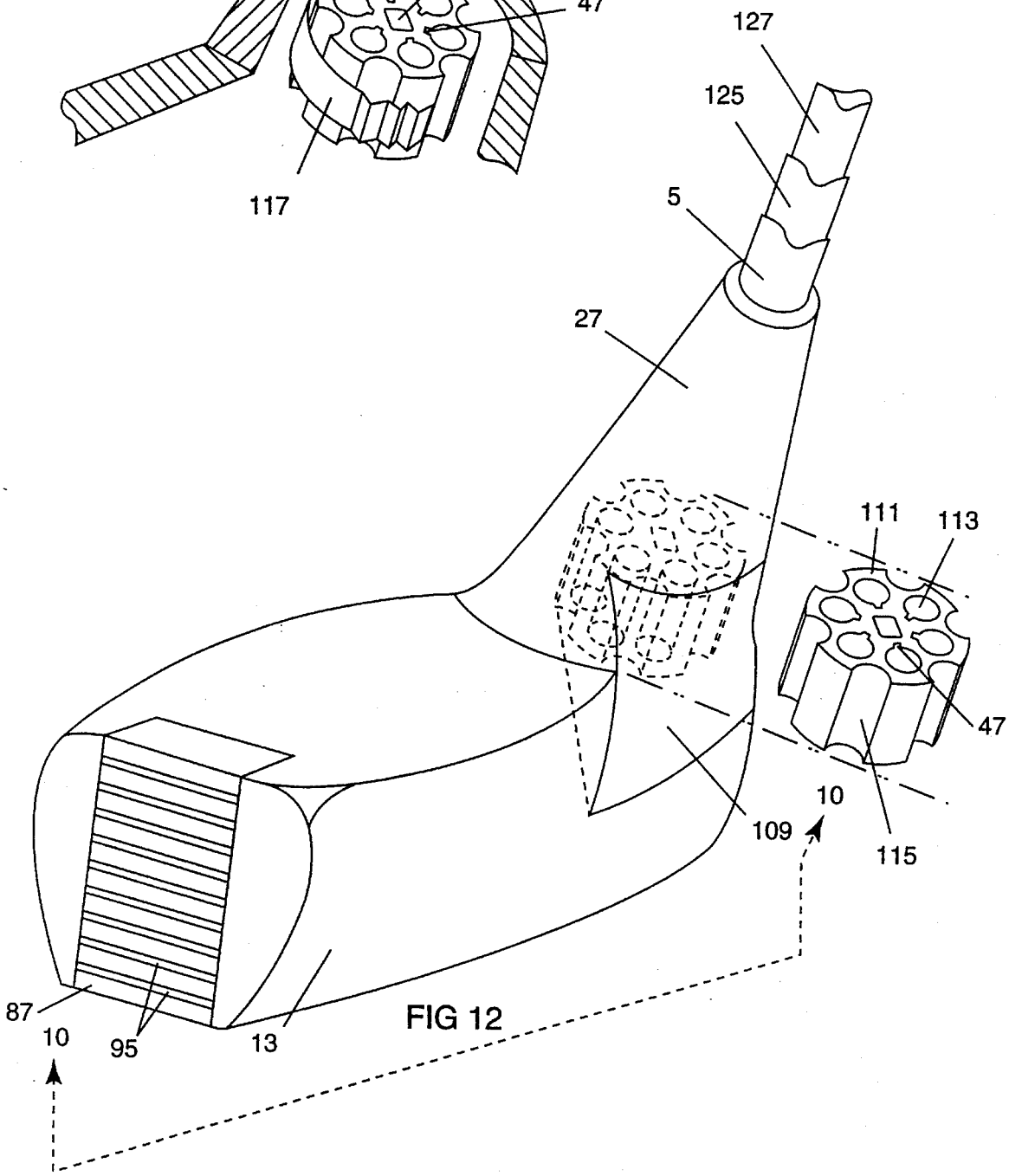
FIG. 12 shows a perspective view of an alternate golf head embodiment showing the disk shaped cartridge holder being inserted into the breach.

In an alternate embodiment of the firing mechanism, best seen in FIG. 10, 12, and 13, a U-shaped breach chamber 109 rather than the square shaped breach chamber 31 of the prior embodiment is formed within piston housing 13 at the junction between piston housing 13 and firing pin housing 27 for receiving disk shaped cartridge holder 79.

In this alternate embodiment a circular cross section bore 119, rather than the hexagonal bore 53 of the prior preferred embodiment, extends from firing pin housing tip 29 to rectangular cross section firing pin chamber 123. The diameter of bore 119 abruptly increases forming an upper firing pin shoulder 121.

One end of tubular elongated hollow shaft 5 is fixed inside bore 119 with the end of hollow shaft 5 even with upper firing pin spring shoulder 121. Firing pin linkage 125 is tubular with an external diameter smaller than the internal diameter of elongated handle 5, and is slideably received in hollow shaft 5. Cylindrical cartridge index rod 127, having a diameter smaller than the internal diameter of firing pin linkage 125, and having a square index engagement spline 137 at one end, is slideably received within, and extends through, firing pin linkage 125 past the end of firing pin linkage 125 into U-shaped breach chamber 109. Firing pin block clamp 131 is fastened onto the end of firing pin linkage 125 by tightening firing pin block clamp screw 133. Firing pin 135 is fixed to a lower corner of firing pin block clamp 125. Helical firing pin compression spring 129 is engaged over and around the portion of firing pin linkage 125 exposed in bore 119 and having one end engaging upper firing pin spring shoulder 121 and the other end engaging firing pin block clamp 131. Firing pin compression spring 129 need not be fixed to either firing pin spring shoulder 121 or firing pin block clamp 131 because its inherent spring energy will tend to keep firing pin compression spring 129 engaged with these members.

Referring to FIG.'s 12 and 13, disk shaped cartridge holder 111 contains a plurality of cartridge containment holes 113 spaced apart on disk shaped cartridge holder 111, and extending entirely through cartridge holder 111. Six Cartridge containment holes is preferred, but more or less than six may be used .222 caliber cartridge rounds 49 are inserted in each cartridge containment hole 113 All of the .222 caliber cartridge rounds 49 are oriented in the same direction. Disk shaped cartridge holder 111 contains channel notches 115, one channel notch 115 corresponding to each cartridge containment hole 113. Cartridge holder 111 also includes a square cross section index engagement notch 138.

Arched ejection and alignment spring 117, seen in FIG. 13, having a cartridge alignment loop 139 is fixed in U-shaped breach chamber 109. Cartridge holder 111 is inserted into breach chamber 109 deforming ejection and alignment spring 117. Spring energy stored in ejection and alignment spring 117 tends to urge cartridge holder 111 out of breach chamber 109. Cartridge holder 111 is held in place in breach chamber 109 by insertion of index engagement spline 137 of cartridge index rod 127 into index engagement notch 138. Engagement of cartridge alignment loop 139 of arched ejection and cartridge alignment spring 117 holds one .222 cartridge 49 in cartridge holder 111 in proper position with firing pin 135 and with injection port 32.

Cartridge holder 111 can be rotated around its vertical axis to align other cartridges 49 with firing pin 135 and injection port 32 by turning cartridge index rod 127 until alignment loop 139 engages the channel notch 115 corresponding to the next un-fired cartridge 49.

Figure 11:
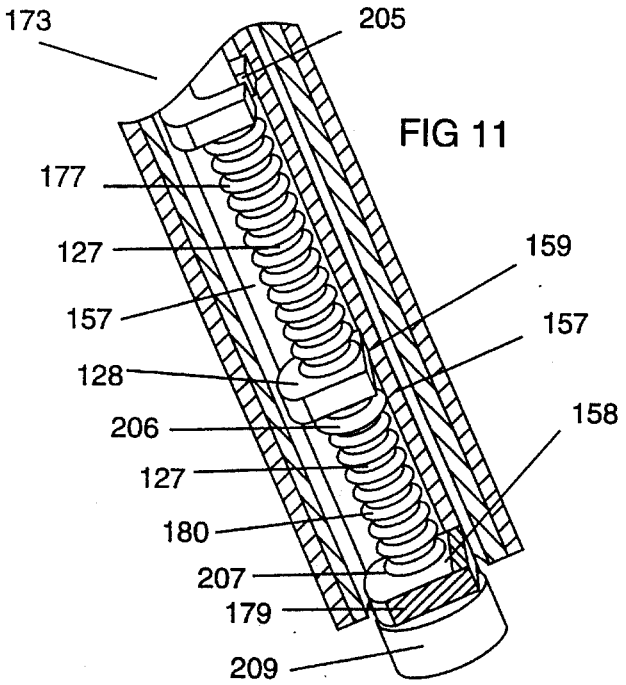
FIG. 11 shows a partial sectional view of an alternate embodiment of the handle assembly.

In this alternate embodiment, handle assembly 143 is also slightly different from that of the first preferred embodiment, as seen in FIG. 11. In this embodiment, firing pin linkage 145, not shown in FIG. 11 is tubular. The handle assembly end of cartridge index rod 127 extends through firing pin linkage tube 145, through rear pawl notch 205 of rear paw 173, through the coils of cocking handle return spring 177 and out rear handle member wall hole 207 in rear wall 179 of handle member 153 forming index spring shoulder 158. Cocking handle return spring 177 is engaged with retainer 128 is fixed in channel 161 of rear handle member 157. Knob 209 is fixed to end of firing pin index rod 127. By turning knob 209, firing pin index rod is turned, turning disk shaped cartridge holder 111, thereby aligning new un-fired cartridge 49 with firing pin 135. Helical compression cartridge index rod spring 180 is engaged at one end with cartridge index rod 127 by snap ring 206 fixed to cartridge index rod, and at the other end with index spring shoulder 158 cartridge index rod spring 180 need not be affixed to snap ri shoulder 158 because its inherent spring energy will tend to keep it engaged with both members.

The ballistic impeller golf club is easily used. The sequence of operation of the ballistic ball impeller golf club is that a cartridge holder 33 is inserted having cartridge 49 of a chosen powder load. Different powder loads are available in .222 caliber cartridges sold in retail stores. The firing mechanism, as explained previously, is cocked by pulling the cocking handle 16 back until the trigger lever end 191 engages the trigger shoulder 147.

Club head 3 is placed approximately ½ inch behind the golf ball. The alignment of strike plate 87 is positioned with the longitudinal axis of piston rod 91 pointing toward the center of the golf ball. Safety button 11 is pulled back, then subsequently trigger button 9 is pressed. Firing linkage 127 is thereby released and is urged downward by firing spring 151. Firing pin 57 contacts cartridge 49 detonating cartridge 49.

The hot gas from cartridge 49 expands and moves through injection port 32. Piston 93 is forced to the opposite end of piston cylinder 15 where the hot gas is vented through cylinder discharge ports 21 and 23 into silencer expansion chambers 17 and 19 then out of club head 3 through silencer discharge ports 21. Piston 93 and attached strike plate 87 move approximately 1.5 inches impacting the golf ball, impelling ball down course.

Marshmallow spring snubber ring 105 and piston return spring 107 absorb the remaining energy of piston 93 before piston return spring 107 returns piston 93 back to ready position.

The flight of the golf ball is the very essence of the game and the judgment of distance is keenly observed and altered as the game is played. Golf ball flight variations are learned by a player thereby creating greater proficiency.

Ballistic impeller golf clubs are designed to drive a golf ball from 2 yards to 250 yards and achieve ball lofts equivalent to a #1 "wood" or driver, a 5 iron and 9 iron of conventional clubs. These equivalents are achieved by providing differing angles of strike plate 87. The ball's different driving ranges are achieved with the use of different powder loads in the cartridges 49 and the use of clubs with different strike plate angles.

The purpose of the different strike plate angles is to allow a player to place the ball on the fariway or green at different vertical angles thereby creating better ball control and avoiding a skipping effect by altering the vertical angle at which the struck ball strikes the respective playing area.

The start of a golf game usually requires a drive to or toward the green and possible subsequent other shots before putting the ball into the hole depending on the length of the course. To achieve this process on longer holes the club with the lowest face angle would be selected with the cartridge 49 containing the maximum explosive charge. The second shot depending on the distance needed could require a medium strike plate angle with a cartridge having a medium explosive charge.

The next shot may be 10 or 15 yards to the hole where the player would select the short range club with maximum strike plate angle and use a cartridge having a small explosive charge.

The final strokes would be accomplished with a conventional putter where one or more putts may be required depending upon play proficiency.

While the above description contains many specificities, the examples given should not be construed as limitations on the scope of the invention, but merely as exemplifications of preferred embodiments thereof. Additional advantages and modifications will readily occur to those skilled in the art. The invention in its broader aspects is therefore not limited to the specific details, representative apparatus and illustrative examples shown and described. Accordingly it should be apparent to those skilled in the art that variations and modifications are possible without departing from the spirit of the invention.

What is claimed is:

1. A ballistic impeller golf club comprising:

a golf club having a club head having an exterior surface, a front face, a shaft having a first end and a second end affixed to said club head at said first end of said shaft, and a handle affixed to said shaft at said second end of said shaft, said front face of said club head having a strike plate associated with said front face of said club head, said strike plate being rigidly affixed to a piston which is slideably supported within a piston cylinder formed within said club head, said piston cylinder having a forward end nearest said strike plate, said club head further comprising urging means comprising means for generating gas under pressure by detonating an explosive charge effective to force said piston along said piston cylinder urging said attached strike plate away from said front face of said club head; and an explosive charge placement means comprising means for removeably inserting and positioning for detonation said explosive charge within a breach chamber formed in said club; and a triggering means for detonating said explosive charge designed and arranged to be operated by the hand of a person holding said handle of said golf club while operating said golf club;

whereby a person operating said golf club may trigger said explosive charge, without swinging said golf club, causing said gas pressure to urge said piston along said piston cylinder, urging said strike plate away from said front face of said club into contact with a golf ball, impelling the golf ball down the course.

2. The golf club of claim 1 wherein said club head further comprises a plurality of silencing chambers formed within said club head, said silencing chambers being in gas communication with said piston cylinder and said exterior of said club head.

3. The golf club of claim 1 wherein a piston decelerating means comprising a piston snubber marshmallow ring is positioned within said forward end of said piston cylinder.

4. The golf club of claim 1 wherein said explosive charge is a .222 caliber cartridge.

5. The golf club of claim 1 wherein said triggering means includes a cocking means for preparing a firing means to detonate said explosive charge, a firing means for detonating said explosive charge, and a safety means for preventing premature or accidental detonation of said explosive charge.

6. The golf club of claim 4 wherein said explosive charge placement means comprises a rectangular cartridge holder having an upper surface and a lower surface, and having 4 cartridge containment holes spaced one in each corner of said cartridge holder extending through said cartridge holder from said upper to said lower surface, wherein a plurality of .222 caliber cartridges are placed in alternating orientations, whereby said cartridge holder may be rotated along a vertical or horizontal axis in order to engage any one of said .222 caliber cartridges contained in said cartridge holder for detonation by said triggering means.

7. The golf club of claim 4 wherein said explosive charge placement means comprises a disk shaped cartridge holder having an upper and a lower surface, and having a plurality of cartridge containment holes extending through said disk shaped cartridge holder from said upper surface to said lower surface, and spaced apart from each other, wherein said .222 caliber cartridges are placed in said cartridge containment holes in a same orientation.

8. The golf club of claim 7 wherein said disk shaped cartridge holder can be rotated around a vertical axis within said breach chamber, without removing said cartridge holder from said breach chamber, in order to select any one of said .222 caliber cartridges for detonation by said triggering means.

9. The golf club of claim 1 wherein said explosive charge may have a predetermined explosive power generating a given impelling force, and wherein said impelling force may be varied by varying the choice of said explosive power of said explosive charge used.

10. A ballistic impeller golf club comprising:

a golf club having a club head having an exterior surface, a shaft having a first end and a second end affixed to said club head at said first end of said shaft, and a handle affixed to said shaft at said second end of said shaft, said club head further comprising a front face and a strike plate associated with said front face of said club head, said strike plate being rigidly affixed to a piston which is slideably supported within a piston cylinder formed within said club head, said piston cylinder having a forward end nearest said strike plate, a piston decelerating means comprising a piston snubber marshmallow ring being positioned within said forward end of said piston cylinder, said club head further comprising urging means comprising means for generating gas under pressure by detonating a .222 caliber cartridge to force said piston along said piston cylinder, urging said attached strike plate away from said front face of said club head, and said club head further comprising a plurality of silencing chambers formed within said club head, said silencing chambers being in gas communication with said piston cylinder and said exterior of said club head; and a rectangular cartridge holder having an upper surface and a lower surface, and having 4 cartridge containment holes spaced one in each corner of said cartridge holder extending through said cartridge holder from said upper to said lower surface, wherein a plurality of .222 caliber cartridges are placed in said cartridge holder in alternating orientations, whereby said cartridge holder may be rotated along a vertical or horizontal axis in order to engage any one of said .222 caliber cartridges contained in said cartridge holder for detonation by triggering means; and a triggering means for detonating one of said .222 caliber cartridges designed and arranged to be operated by the hand of a person holding said handle of said golf club while operating said golf club, said triggering means including a cocking means for preparing a firing means to detonate said .222 caliber cartridge, a firing means for detonating said .222 caliber cartridge, and a safety means for preventing premature or accidental detonation of said .222 caliber cartridge;

whereby a person operating said golf club may trigger said .222 caliber cartridge, without swinging said golf club, causing said gas pressure to urge said piston along said piston cylinder, urging said strike plate away from said front face of said club into contact with a golf ball, impelling the golf ball down the course.

11. A ballistic impeller golf club comprising:

a golf club having a club head having an exterior surface, a shaft having a first end and a second end affixed to said club head at said first end of said shaft, and a handle affixed to said shaft at said second end of said shaft, said club head further comprising a front face and a strike plate associated with said front face of said club head, said strike plate being rigidly affixed to a piston which is slideably supported within a piston cylinder formed within said club head, said piston cylinder having a forward end nearest said strike plate, a piston decelerating means comprising a piston snubber marshmallow ring being positioned within said forward end of said piston cylinder, said club head further comprising urging means comprising means for generating gas under pressure by detonating a .222 caliber cartridge to force said piston along said piston cylinder urging said attached strike plate away from said front face of said club head, and said club head further comprising a plurality of silencing chambers formed within said club head, said silencing chambers being in gas communication with said piston cylinder and said exterior of said club head; and a .222 caliber cartridge placement means comprising a disk shaped cartridge holder rotatably received in said breach chamber, said cartridge holder having an upper and a lower surface, and having a plurality of cartridge containment holes extending through said disk shaped cartridge holder from said upper surface to said lower surface, and spaced apart from each other, wherein a plurality of .222 caliber cartridges are placed in said cartridge containment holes in a same orientation, wherein said disk shaped cartridge holder can be rotated around a vertical axis within said breach chamber, without removing said cartridge holder from said breach chamber, in order to select any one of said .222 caliber cartridges for detonation by said triggering means; and a triggering means for detonating one of said .222 caliber cartridges designed and arranged to be operated by the hand of a person holding said handle of said golf club while operating said golf club, said triggering means includes a cocking means for preparing a firing means to detonate said .222 caliber cartridge, a firing means for detonating said .222 caliber cartridge, and a safety means for preventing premature or accidental detonation of said .222 caliber cartridge;

whereby a person operating said golf club may trigger said .222 caliber cartridge, without swinging said golf club, causing said gas pressure to urge said piston along said piston cylinder, urging said strike plate away from said front face of said club into contact with a golf ball, impelling the golf ball down the course.

* * * * *

UNITED STATES PATENT AND TRADEMARK OFFICE

CERTIFICATE OF CORRECTION

PATENT NO. : 5,522,594

DATED : Jun. 4, 1996

INVENTOR(S) : Roy H. Taylor et al.

It is certified that error appears in the above-indentified patent and that said Letters Patent is hereby corrected as shown below:

Col. 3, line 50, "pods" should read - - ports - -.

Col. 3, line 53, "pods" should read - - ports - -.

Col. 3, line 56, "pods" should read - - ports - -.

Col. 3, line 57, "pods" should read - - ports - -.

Col. 4, line 20, "87, is fixed" should read - - 87 is fixed - -.

Col. 8, line 4, "may be used .222 caliber" should read - - may be used. .222 caliber - -.

Col. 8, line 5, "hole 113 All of the" should read - - hole 113. All of the - -.

Col. 8, line 34, "paw" should read - - pawl - -.

Col. 8, line 48, "snap ri shoulder" should read - - snap ring 206 or index spring shoulder - -.

UNITED STATES PATENT AND TRADEMARK OFFICE

CERTIFICATE OF CORRECTION

PATENT NO. : 5,522,594

DATED : Jun. 4, 1996

INVENTOR(S) : Roy H. Taylor et al.

It is certified that error appears in the above-indentified patent and that said Letters Patent is hereby corrected as shown below:

Claim 6, col. 10, line 41, "in alternating orientations" should read - - in said cartridge holder in alternating orientations - -.

Claim 10, col. 11, lines 30-31, "by triggering means" should read - - by a triggering means - -.

Signed and Sealed this

Twenty-fifth Day of February, 1997

*Attest:*

*Attesting Officer*

BRUCE LEHMAN

*Commissioner of Patents and Trademarks*